US006978566B2

(12) United States Patent
Broelemann

(10) Patent No.: US 6,978,566 B2
(45) Date of Patent: Dec. 27, 2005

(54) BACKLIT SIGN

(75) Inventor: Rolf Broelemann, Salzkotten (DE)

(73) Assignee: Goodrich Hella Aerospace Lighting Systems GmbH, Lippstadt (DE)

( * ) Notice: Subject to any disclaimer, the term of this patent is extended or adjusted under 35 U.S.C. 154(b) by 0 days.

(21) Appl. No.: 10/621,525

(22) Filed: Jul. 18, 2003

(65) Prior Publication Data

US 2004/0055193 A1 Mar. 25, 2004

Related U.S. Application Data

(60) Provisional application No. 60/397,196, filed on Jul. 22, 2002.

(30) Foreign Application Priority Data

Jul. 18, 2002 (EP) ..... 02015992

(51) Int. Cl.[7] ..... G09F 13/04
(52) U.S. Cl. ..... 40/564
(58) Field of Search ..... 40/564, 570, 575, 40/577, 578, 580; 362/29, 812

(56) References Cited

U.S. PATENT DOCUMENTS 4,367,604 A * 1/1983 Porter et al. ..... 40/564
4,848,017 A * 7/1989 Bailey et al. ..... 40/576
5,263,271 A 11/1993 Cox et al.
6,131,322 A * 10/2000 Hjaltason ..... 40/615
6,471,388 B1 * 10/2002 Marsh ..... 362/559
6,641,880 B1 * 11/2003 Deyak et al. ..... 428/35.7
2001/0053071 A1 12/2001 Yoda et al.

FOREIGN PATENT DOCUMENTS

DE 40 06 649 C1 8/1991
EP 0 547 943 A1 6/1993
JP 9-311650 A 12/1997

* cited by examiner

*Primary Examiner*—Andrew D. Wright
(74) *Attorney, Agent, or Firm*—Birch, Stewart, Kolasch & Birch, LLP

(57) ABSTRACT

The sign adapted to be backlit is provided with a cover element (14) having a front side (18) with at least one symbol field (26,28) adapted to be backlit and a rear side (22) facing away from the front side (18). The front side (18) is formed by a transparent plastic sheet (16) provided with a translucent color (20). The rear side (22) is formed by injecting plastic injection molding material from behind against the plastic sheet (16). This plastic injection molding material opaquely covers the plastic sheet (16) while sparing the at least one symbol field (26,28).

8 Claims, 1 Drawing Sheet

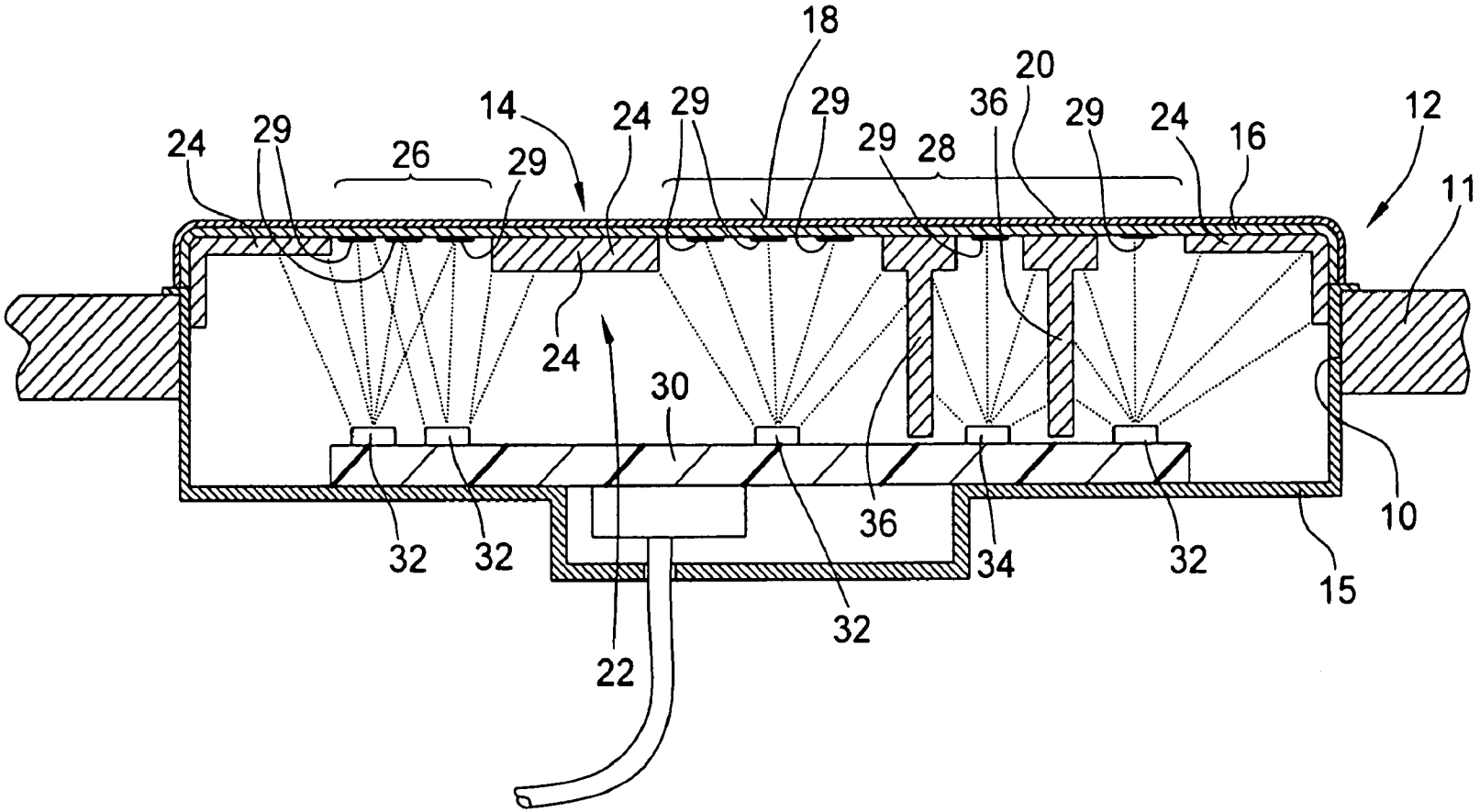
12
11
10
15
16
24
29
20
36
28
29
18
29
29
24
14
29
26
29
24
32
34
36
32
30
22
24
32
32

BACKLIT SIGN

This application claims priority on provisional Application No. 60/397,196 filed on Jul. 22, 2002, and EPO Application No. 02015992.7 filed Jul. 18, 2002, the entire contents of each of which are hereby incorporated by reference.

BACKGROUND OF THE INVENTION

1. Field of the Invention

The invention relates to a sign adapted to be backlit such as it is used, for example, as an indicating light in buildings and vehicles and particularly in airplanes.

2. Description of Related Art

In a plurality of applications, information is visually indicated via display surfaces adapted to be backlit (U.S. Pat. No. 5,263,271, U.S. Pat. No. 2001/053071, European Patent No. 0 547 943, Japanese Patent No. 09 311 650, DE-C-40 06 649). Such signs adapted to be backlit can be found, for example, in airplanes to indicate whether the toilets are occupied or not or to illustrate the "fasten your seatbelt" and "no smoking" signs. The two last-mentioned visual signs are located directly above the passengers and form part of the so-called passenger service units (PSU).

Basically, backlit sign surfaces consist of a transparent plastic material as cover element on the front side of which indication information is printed for illustrating the symbols or the like. Over this printed front side, an opaque lacquer is applied which is laid bare in the region of the symbols. Subsequently, the entire front side of the cover element is then coated with a translucent color. Due to this color layer application, the symbol fields shall hardly be detectable and ideally be non-detectable for the observer when they are not backlit.

In practice, however it has turned out that the front side of the cover elements structured due to the application of the diverse lacquer layers is nevertheless relatively clearly visible because of shadow effects of the ambient light when the symbol fields are not backlit. This is found not very aesthetically appealing.

In prior art, it is further known to use printed sheets at the front side of the front cover of operating units, these sheets being injection-molded from behind with plastics. The sheets are printed with an opaque color and only transparent in the region of the symbol zone to be backlit. These symbol zones shall also be visually detectable without backlighting, e.g., in daylight.

Accordingly, there is an ongoing need to improve the visual appearance of a sign adapted to be backlit, particularly when the sign is not backlit.

SUMMARY OF THE INVENTION

The present invention provides a backlit sign comprising a cover element having a front side with at least one symbol field adapted to be backlit and a rear side facing away from the front side, the front side being formed by a transparent plastic sheet provided with a translucent color, and the rear side being formed by injecting plastic injection molding material from behind against the plastic sheet and this plastic injection molding material opaquely covering the plastic sheet while sparing the at least one symbol field.

The sign adapted to be backlit according to the invention is a two-part construction and comprises a transparent plastic sheet forming the front side of the cover element, behind which opaque plastic injection molding material is injected. This manufacturing process, e.g., is effected in an insert injection molding die, the transparent plastic sheet serving as insert member. On the (front) side facing away from the plastic injection molding material injected from behind, this plastic sheet is provided with translucent color. On its rear side, the plastic sheet is exposed in the region of the at least one symbol field.

Because of the construction of the cover element according to the invention, the latter has a plane and hence unstructured front side formed by the sheet. Technically, printing on sheets can be done much more easily and precisely than on the surface of non-laminar material. For the printing techniques can particularly be applied advantageously with flat sheet materials without the printing colors appearing raised in a visually detectable manner. Therefore, the symbol fields are not detectable in the non-backlit state of the sign. The transparent plastic sheet is so thin that backlighting light fed from the rear side of the cover element via the symbol fields emerges at the lateral edges of the plastic sheet in a visually non-detectable manner. Hence, the light guidance to the outer edge of the sheet necessarily provided by the transparent plastic sheet is visually non-detectable.

In an advantageous embodiment of the invention, it is provided that the plastic sheet is printed within the at least one symbol field for producing a graphic symbol, a letter symbol and/or numeral or another indication symbol, particularly according to the screen printing method. In this connection, it has to be mentioned that the term "printing" is to be understood rather generally and is not limited to a printing procedure in the actual sense. It has been found out, however, that screen printing is particularly advantageous with respect to a homogeneous printing format.

According to the information to be indicated visually, it is required that a symbol field of the sign adapted to be backlit has to be backlit in different colors. This is the case, for example, with the "no smoking" sign in an airplane, which includes a stylized cigarette representation and, e.g., a cross with red bars. For shading the portions of the symbol field to be backlit in different colors, it is advantageous if at least one light shading web formed of the plastic injection molding material projects from the rear side of the plastic sheet within the symbol field.

Alternatively, the sheet may be printed with different colors and the entire symbol field may be backlit with backlighting light of the same color, e.g., white, to produce different colors within the symbol fields.

BRIEF DESCRIPTION OF THE DRAWING

Hereinafter, the invention will be explained in detail with reference to the drawing wherein a cross section through a sign adapted to be backlit is represented.

DETAILED DESCRIPTION OF A PREFERRED EMBODIMENT

In this embodiment, an insert member 12 adapted to be backlit is clipped into the opening 10 of a wall 11, comprising a cover element 14 made of a plastic material and a housing member 15. This cover element 14 comprises a transparent plastic sheet 16 the one side of which which forms the front side 18 of the cover element 14 being provided with a translucent color layer 20. Plastic injection molding material is injected behind the sheet 16 to form a circumferential border 24 projecting from the rear side 22 of the cover element 14. This plastic injection material covers the rear side of the sheet 16 except for symbol fields 26, 28, which are provided with printed symbol 29 at the rear side of the sheet 16.

Behind the cover element 14, a printed circuit board 30 comprising light-emitting diodes 32,34 for backlighting the symbol fields 26,28 is arranged within the housing member 15. Within the symbol fields 26,28, the sheet 16 is printed, for example, by the screen printing method.

The plastic sheet 16, for example, consists of transparent polycarbonate (PC), while the plastic injection molding material injected from behind is an opaque molding material. The cover element 14 is produced in an injection molding die into which the transparent plastic sheet 16 is inserted before injecting the injection molding material.

As can be seen from the drawing, light shading webs 36 projecting from the cover element 14 within the symbol field 28 and reaching to the board 30 are located at the rear side of the cover element 14. By means of this light shading webs, it is achieved that the light of the light-emitting diode 34 does not laterally come out of the region defined by the light shading webs 36. Thereby, a separation of the light of the light-emitting diode 34 of that of the light-emitting diodes 32 is given within the symbol field 28.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A sign adapted to be backlit, comprising:

a cover element having a front side with at least one symbol field adapted to be backlit and a rear side facing away from the front side, the front side being formed by a transparent plastic sheet having a translucent color provided thereon, and the rear side being formed by plastic injection molding material being provided against the plastic sheet, the plastic injection molding material opaquely covering the plastic sheet while sparing the at least one symbol field, wherein the plastic sheet is printed within the at least one symbol field for producing a graphic symbol, a letter symbol and/or numeral or an indication symbol.

2. The sign adapted to be backlit according to claim 1, wherein the printing is applied on a rear side of the plastic sheet.

3. The sign adapted to be backlit according to claim 2, wherein the printing has different colors.

4. The sign adapted to be backlit according to claim 3, wherein the at least one symbol field is adapted to be backlit with monochrome light.

5. The sign adapted to be backlit according to claim 2, wherein the printing is monochrome.

6. The sign adapted to be backlit according to claim 2, wherein at least one light shading web, formed of the plastic injection molding material, projects from the rear side of the plastic sheet within the at least one symbol field.

7. The sign adapted to be backlit according to claim 6, wherein the areas of the at least one symbol field separated by the at least one light shading web are adapted to be backlit with light of different color.

8. The sign adapted to be backlit according to claim 1, wherein the plastic injection molding material facilitates that light from a light source only transverses through the symbol field.

* * * * *